US006179156B1

(12) United States Patent
Aiken

(10) Patent No.: US 6,179,156 B1
(45) Date of Patent: Jan. 30, 2001

(54) MULTI-PURPOSE CONTAINER

(75) Inventor: Cynthia R. Aiken, Lawrenceville, GA (US)

(73) Assignee: Rehrig Pacific Company, Los Angeles, CA (US)

( * ) Notice: Under 35 U.S.C. 154(b), the term of this patent shall be extended for 0 days.

(21) Appl. No.: 09/498,946

(22) Filed: Feb. 4, 2000

(51) Int. Cl.[7] ..... B65D 6/00
(52) U.S. Cl. ..... 220/608; 220/607; 220/1.5
(58) Field of Search ..... 220/608, 607, 220/1.5; 206/509, 512

(56) References Cited

U.S. PATENT DOCUMENTS

| | | | | |
|---|---|---|---|---|
| 2,181,150 | * | 11/1939 | Pittenger | 220/608 X |
| 3,794,208 | * | 2/1974 | Roush et al. | 220/607 |
| 4,389,013 | | 6/1983 | Hall et al. . | |
| 4,497,408 | | 2/1985 | Jes . | |
| 4,645,122 | | 2/1987 | Nederveld . | |
| 4,770,339 | | 9/1988 | Weimer . | |
| 4,936,615 | * | 6/1990 | Moore | 220/1.5 X |
| 5,275,300 | | 1/1994 | Johnson . | |
| 5,335,844 | | 8/1994 | Young . | |
| 5,370,303 | | 12/1994 | Fry . | |
| 5,390,847 | | 2/1995 | Young . | |
| 5,415,293 | | 5/1995 | Ackerman et al. . | |
| 5,429,296 | | 7/1995 | Southwell et al. . | |
| 5,458,283 | | 10/1995 | Southwell et al. . | |
| 5,497,939 | | 3/1996 | Heiskell et al. . | |
| 5,551,594 | * | 9/1996 | Schäfer | 220/1.5 X |
| 5,690,275 | | 11/1997 | Bose et al. . | |
| 5,735,431 | * | 4/1998 | Le Trudet | 220/1.5 X |
| 5,839,650 | | 11/1998 | Sheffer . | |

OTHER PUBLICATIONS

Photographs of Fruit Container Company Crate (believed to be prior art) (4 pages).

* cited by examiner

*Primary Examiner*—Steven Pollard
(74) *Attorney, Agent, or Firm*—Brooks & Kushman P.C.

(57) ABSTRACT

A multi-purpose container, such as for storing and transporting produce, includes a bottom surface, a first pair of opposed walls integrally joined with the bottom surface and extending upwardly therefrom, and a second pair of opposed walls integrally joined with the bottom surface and extending upwardly therefrom. The first and second pairs of opposed walls are integrally joined with each other to define, along with the bottom surface, a storage area. The bottom surface has a ridge that includes at least one vertical rib that extends along the bottom surface between one of the first and second pairs of opposed walls. The rib has an upper end that is covered by a top layer so as to define a smooth profile along the bottom surface. Therefore, the ridge provides reinforcement to the container while minimizing the potential for damaging produce stored and transported therein.

36 Claims, 12 Drawing Sheets

MULTI-PURPOSE CONTAINER

TECHNICAL FIELD

This invention relates to a multi-purpose container for storing and transporting items such as produce.

BACKGROUND ART

Containers for transporting produce, such as grapes, from the fields where they are grown to the markets where they are purchased are well known. Currently, three different materials are used to construct such containers: wood, corrugated cardboard, and plastic. Wood containers are typically expensive to manufacture, employ non-recyclable materials, and have excessive weight which adds to the cost of shipping and handling. In addition, wood degrades under long term exposure to environmental conditions, such as rain. Corrugated cardboard containers are lighter, recyclable, and less expensive to manufacture than wood, but tend to degrade when in contact with moisture. In addition, for corrugated cardboard containers, a trade-off exists between providing adequate ventilation and providing structural strength. Plastic containers, on the other hand, possess the desirable qualities of wood and corrugated cardboard containers without many of the inheren disadvantages. In particular, plastic containers are lightweight and inexpensive, are able to withstand a range of environmental conditions, provide structural strengt even when designed for proper ventilation, and are reusable.

In addition to the materials used, the specific construction of the container is important to successful produce harvesting, shipping, and storage. For example, it is desirable that containers be reinforced in some manner so as to improve their structural strength. Reinforcement is necessary to ensure that handling will not damage the containers, as well as to provide sufficient strength for stacking of the containers during shipping and storage. Unfortunately, typical container reinforcements include corners or edges which pose the potential risk of bruising or otherwise damaging the perishable produce within the container. Such features may result in more problems towards the bottom of the container, where weight from the produce above creates the greatest pressure, and potential for damage, on the produce below. Furthermore, reinforcements often add significantly to the weight or cost of manufacturing the containers.

It is also desirable to minimize the space required for storing the containers when they are not in use. One method of storing containers to conserve space is to stack them in a nesting manner one within another. If containers with detachable lids are to be nested in such a manner, the lids must be removed in order to allow the containers to nest properly, and are therefore prone to being misplaced. Alternatively, containers with hinged lids may not have enough clearance when the lids are opened to be able to nest containers, or may increase the floor space required to store the containers.

Therefore, a need exists for an improved container for harvesting, shipping, and storing produce, such as grapes, that provides adequate protection and ventilation for the produce, is reinforced to provide sufficient strength to withstand handling, shipping, and storage, and is designed for convenient storage when not in use.

DISCLOSURE OF INVENTION

Therefore, it is an object according to the present invention to provide a multi-purpose container that provides adequate protection for items, such a produce, stored and transported therein while still providing sufficient ventilation.

It is another object according to the present invention to provide a multi-purpose container that is reinforced for improved strength characteristics.

It is a further object according to the present invention to provide a multi-purpose container that is free of any sharp or rough internal surfaces so that items, such as produce, stored therein are not susceptible to damage.

It is another object according to the present invention to provide a multi-purpose container that is designed so that a plurality of such containers can be placed in a stacked configuration.

It is yet another object according to the present invention to provide a multi-purpose container that is capable of being placed in a nested configuration with other such containers for convenient storage.

Accordingly, a multi-purpose container is provided that includes a first pair of opposed walls and a second pair of opposed walls that is integrally joined with the first pair of opposed walls. The container further includes a bottom surface that is integrally joined with the first and second pairs of opposed walls, such that the first and second pairs of opposed walls extending upwardly from the bottom surface to define a storage area. The bottom surface has a ridge which includes at least one vertical rib which extends along the bottom surface between one of the first and second pairs of opposed walls. The rib has an upper end that is covered by a top layer so as to define a smooth profile along the bottom surface. Therefore, the ridge provides reinforcement to the container while minimizing the potential for damaging items, such as produce, stored and transported therein.

According to a preferred embodiment of the present invention, the ridge extends along a central portion of the bottom surface and includes a plurality of ribs that vary in height. In addition, the bottom surface as well as the first and second pairs of opposed walls preferably include a plurality of ventilation apertures to foster air circulation to and around items stored within the container. One of the first and second pairs of opposed walls may include a wall having a substantially flat open surface area for displaying a label. Preferably, the container is formed from a plastic material.

In further accordance with a preferred embodiment of the present invention, the container includes an upper container rim formed along upper portions of the first and second pairs of opposed walls. The container preferably further includes at least one, and preferably a pair of lids adapted to at least partially cover the container, where the lids preferably include a plurality of ventilation apertures and each pivotably attach via a hinge to the upper container rim along one of the first and second pairs of opposed walls. In a preferred embodiment, the hinge is formed by a plurality of hinge sections, and the lids include indents formed in end edges thereof to receive a user's fingers. In an alternative embodiment, the lid can be removably attached to the container.

Preferably, the hinge allows the lids to be rotated approximately 270° between a closed position and an open position. Each lid preferably includes at least one latching tab for securing the lid to the upper container rim when the lid is in the open position. Still further, each lid preferably includes at least one securing projection formed on a lower surface thereof and the first and second pairs of opposed walls preferably include at least one securing recess in an upper surface thereof corresponding to the securing projection, wherein the securing projection is adapted to be received in the corresponding securing recess in order to secure the lid in the closed position. Most preferably, the first and second pairs of opposed walls include spaced inner columns formed therein, where each inner column is provided with a securing recess in an upper surface thereof.

The lids preferably further include stacking projections formed on an upper surface thereof and the bottom surface preferably includes stacking recesses 20 formed in an underside thereof, such that in a stacked configuration the stacking projections of a lower container are adapted to be received within the stacking recesses of an adjacent upper container.

In further accordance with a preferred embodiment of the preset invention, one of the first and second pairs of opposed walls includes columm sections formed therein, each column section having a recessed portion, an inner shelf, and a lower column support. In addition, one of the first and second pairs of opposed walls preferably includes outer columns formed on an exterior surface thereof opposite the lower column supports. When disposed in a nested configuration, the recessed portion of a lower container is adapted to receive the outer column of an adjacent upper container, providing convenient and easy storage and transport when the containers are empty. Most preferably, the containers of the present invention have a 3:1 nesting ratio.

The above objects and other objects, features, and advantages of the present invention are readily apparent from the following detailed description of the best mode for carrying out the invention when taken in connection with the accompanying drawings wherein like reference numerals correspond to like components.

BEST MODE FOR CARRYING OUT THE INVENTION

Figure 1:
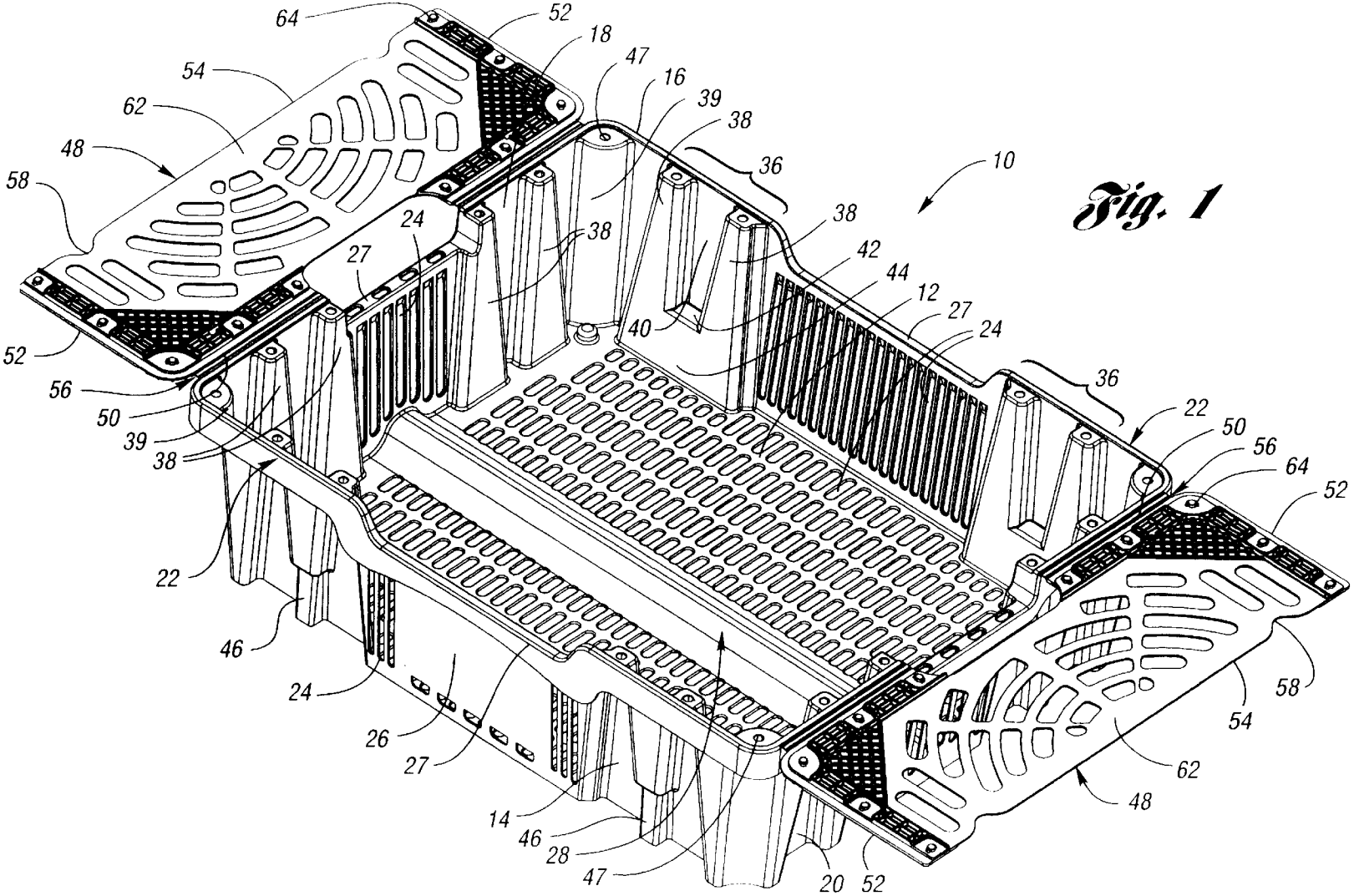
FIG. 1 is a top perspective view of a container constructed in accordance with the present invention.

The multi-purpose container of the present invention, indicated by reference numeral 10, is shown in FIG. 1. Container 10 is suitable for the transport and storage of many items, but it is particularly suited for the transport and storage of perishable produce requiring the circulation of a cooled air flow to keep the produce fresh. More particularly, container 10 is especially adapted for the harvesting, shipping, and storage of grapes. The components of container 10 are formed of various types of plastic or polymeric material via an injection molding or other plastic molding process suitable to this application. More particularly, container 10 is preferably formed by molding a high density plastic material, such as polyethylene or the like.

Referring again to FIGS. 1 and 2, container 10 comprises a bottom surface 12, a first pair of opposed walls 14, 16, and a second pair of opposed walls 18, 20. For convenience, and without additional limitation, first pair of opposed walls 14, 16 will be referred to herein as side walls 14, 16, and second pair of opposed walls 18, 20 will be referred to herein as end walls 18, 20. Side walls 14, 16 and end walls 18, 20 are integrally joined with bottom surface 12 and extend upwardly therefrom. Side walls 14, 16 and end walls 18, 20 are also integrally joined with each other such that side walls 14, 16, end walls 18, 20, and bottom surface 12 together form a storage area, which is preferably substantially rectangular as shown in FIG. 1. In a preferred embodiment, side walls 14, 16 and end walls 18, 20 are not perpendicular to bottom surface 12, but rather are tapered slightly inwardly from their uppermost surfaces to their lowermost surfaces in order to aid in placing containers 10 in a nested configuration.

Figure 2:
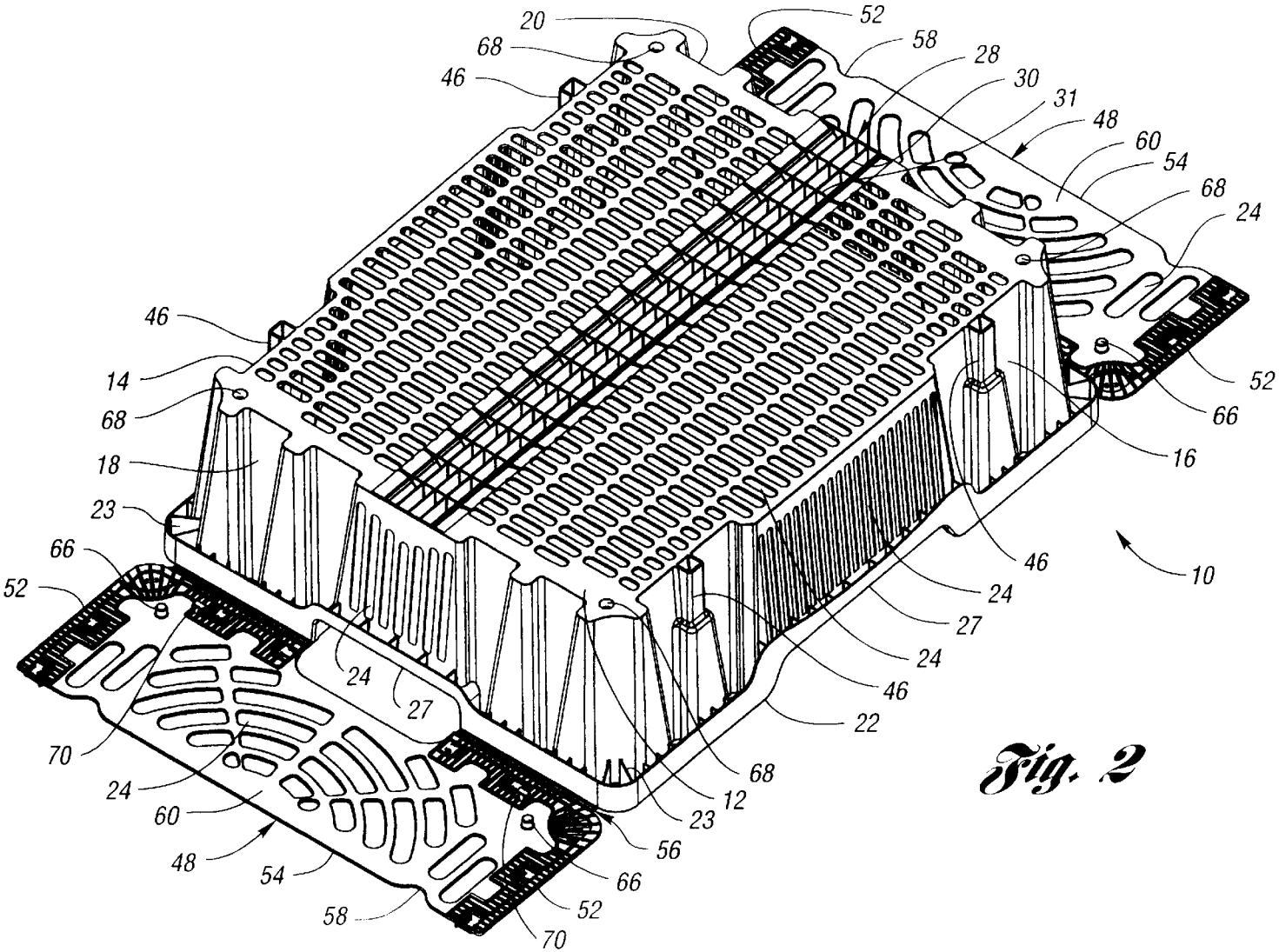
FIG. 2 is a bottom perspective view of the container of the present invention.

Along the uppermost portions of side walls 14, 16 and end walls 18, 20, an upper container rim 22 is formed. As best shown in FIG. 2, upper container rim 22 extends outwardly from side walls 14, 16 and end walls 18, 20, and is reinforced by a plurality of structural ribs 23. As is well understood in the art, the wall thickness of upper container rim 22, bottom surface 12, side walls 14, 16, and end walls 18, 20, as well as other components illustrated and described herein may vary depending on the intended usage and other characteristics desired from container 10.

Referring again to FIGS. 1 and 2, circulation to produce contained within container 10 is fostered through a plurality of apertures provided throughout container 10. In particular, bottom surface 12 includes ventilation apertures 24 to allow for air circulation between containers 10 when in a stacked configuration. In addition, side walls 14, 16 and end walls 18, 20 each include a plurality of ventilation apertures 24 formed in a central portion thereof. It is understood, of course, that ventilation apertures 24 can have any shape and overall layout within bottom surface 12, side walls 14, 16, and end walls 18, 20 in order to provide sufficient ventilation for the contents of container 10. As best shown in FIG. 1, at least one of side walls 14, 16 (particularly shown on side wall 14) also includes a substantially flat open surface area 26 that is devoid of apertures and which can be used to display a label. Side walls 14, 16 and end walls 18, 20 can also include a dropped wall section 27 along a central portion thereof. Dropped wall section 27 comprises a portion of side 14, 16 and end 18, 20 walls where upper container rim 22 is recessed a predetermined distance downwardly toward bottom surface 12.

Although no handles are shown on container 10, handles could easily be formed anywhere proximate upper container rim 22 of side walls 14, 16 and end walls 18, 20.

Figure 3:
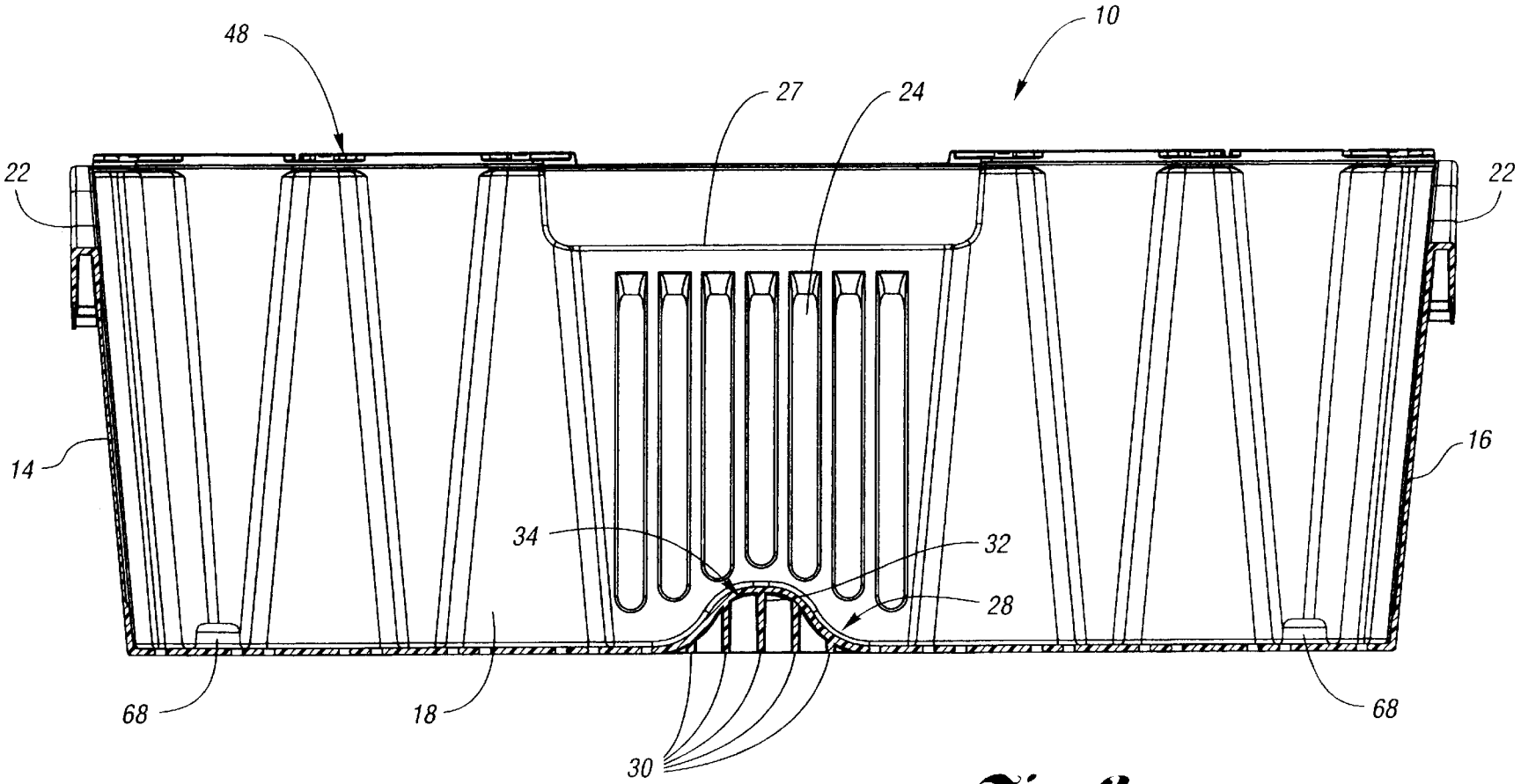
FIG. 3 is an end cross-sectional view taken along line 3—3 of FIG. 4 showing detail of the reinforcement ridge of the present invention.
Figure 4:
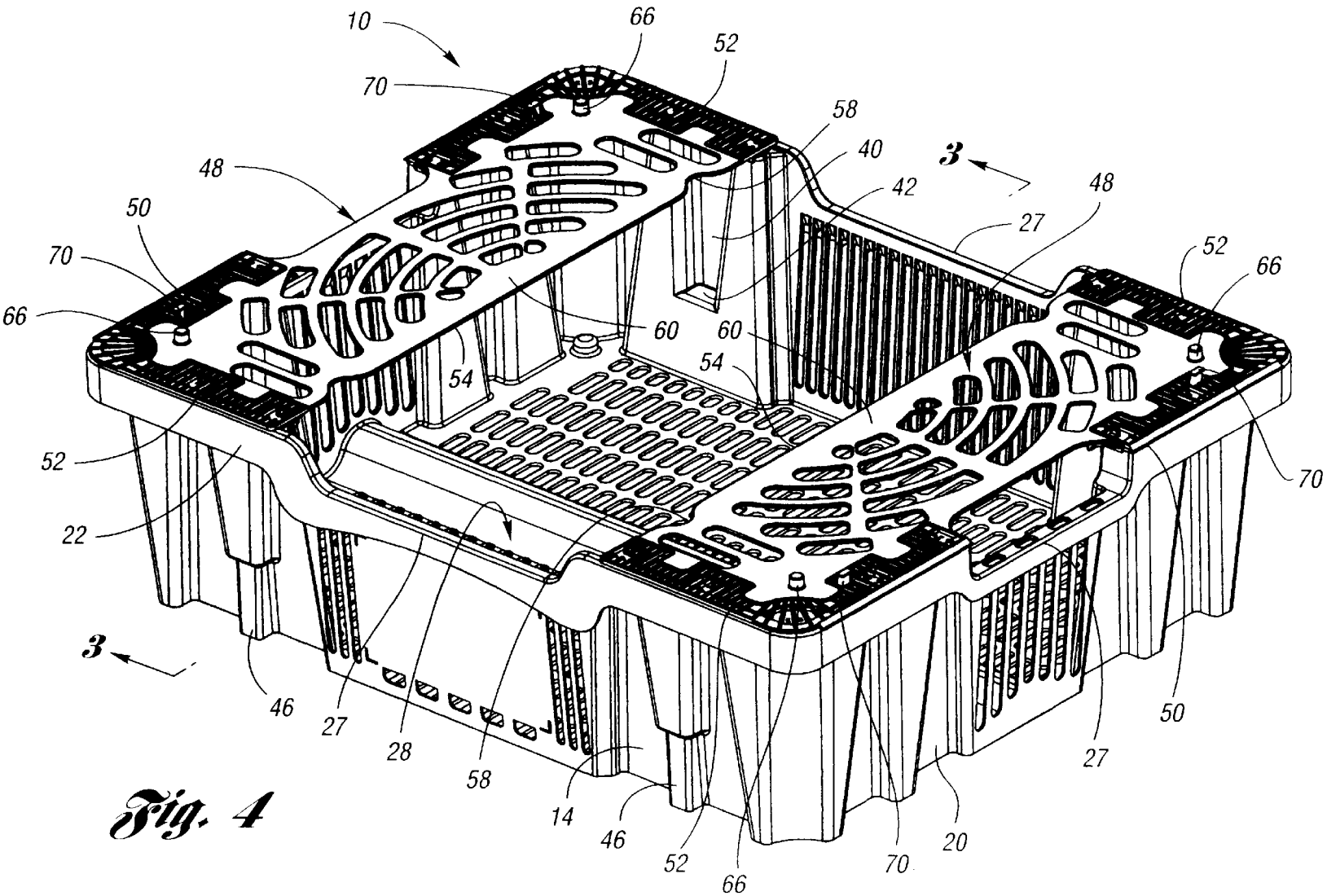
FIG. 4 is a top perspective view of the container of the present invention showing the lids secured to the container in a closed position.
Figure 5:
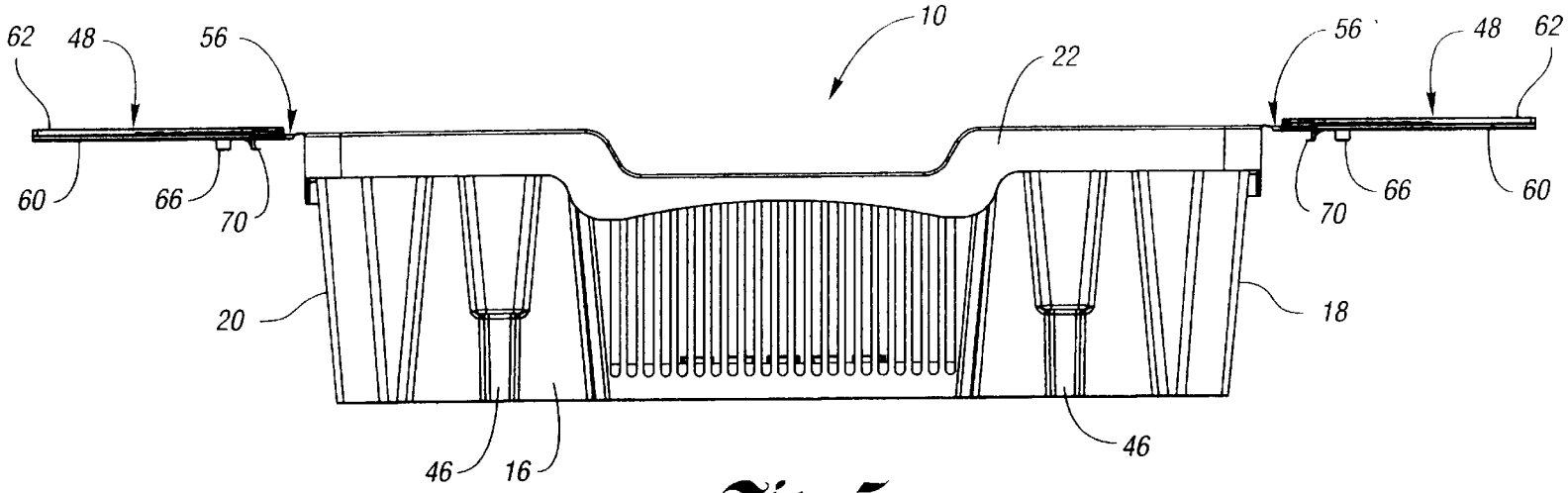
FIG. 5 is a side elevational view of the container of the present invention.

In order to provide reinforcement to container 10 for increased strength during handling and stacking, a raised member or ridge 28 is provided in bottom surface 12 of container 10, as shown in FIGS. 1 and 2, and in the crosssectional view of FIG. 3 taken along line 3—3 of FIG. 4. Ridge 28 is preferably relatively wide and extends along bottom surface 12, either between side walls 14, 16 or end walls 18, 20. In a preferred embodiment, ridge 28 extends longitudinally within a central portion of bottom surface 12 between end walls 18, 20. Ridge 28 includes at least one, and preferably a plurality of spaced apart, vertical ribs 30 (FIGS. 2 and 3) that extend along bottom surface 12. Ridge 28 is preferably further strengthened by a plurality of spaced apart transverse ribs 31 in contact with vertical ribs 30, as best shown in FIG. 2. Preferably, vertical ribs 30 vary in height above bottom surface 12, and have upper ends 32 that are joined by a top layer 34 so as to define a smooth profile along bottom surface 12 (shown herein as an arcuate profile). With this configuration, produce stored and transported within container 10 is protected from any damage, as opposed to a conventional rib which has sharp corners and edges. Ridge 28 is designed to provide torsional strength by reducing the amount of deflection in bottom surface 12 when container 10 is filled with produce, thereby improving the stability of container 10 beyond that provided by a single rib and reducing the potential for damage to the contents of the container below. Ridge 28 can be constructed with any dimensions, but is preferably designed compactly as illustrated herein so as not to remove excessive space from container 10 for storing produce.

With reference again to FIG. 1, side walls 14, 16 each include column sections 36 disposed near the corners of container 10. Each column section 36 includes spaced inner columns 38, a recessed portion 40, an inner shelf 42, and a lower column support 44. Recessed portion 40 of each column section 36 extends downwardly away from upper container rim 22 and terminates in inner shelf 42, which lies substantially parallel to bottom surface 12. Inner shelf 42 is disposed a predetermined distance above bottom surface 12 of container 10, and lower column support 44 is located below recessed portion 40 and adjacent bottom surface 12 of container 10. On an exterior surface of side walls 14, 16 opposite the location of lower column supports 44, outer columns 46 are formed. Outer columns are adapted to be received within recessed portions 40 of column sections 36 when containers 10 are placed in a nested configuration, as described below in association with FIGS. 12 and 13.

Similar to side walls 14, 16, end walls 18, 20 have spaced inner columns 38 disposed near the corners of container 10 (FIG. 1). Additionally, adjacent side walls 14, 16 and end walls 18, 20 share inner columns 39 which are provided in each corner of container 10. Inner columns 38, 39 extend from bottom surface 12 to upper container rim 22, and the upper surfaces of each inner column 38, 39 preferably includes a securing recess 47, the function of which is explained below.

Figure 6:
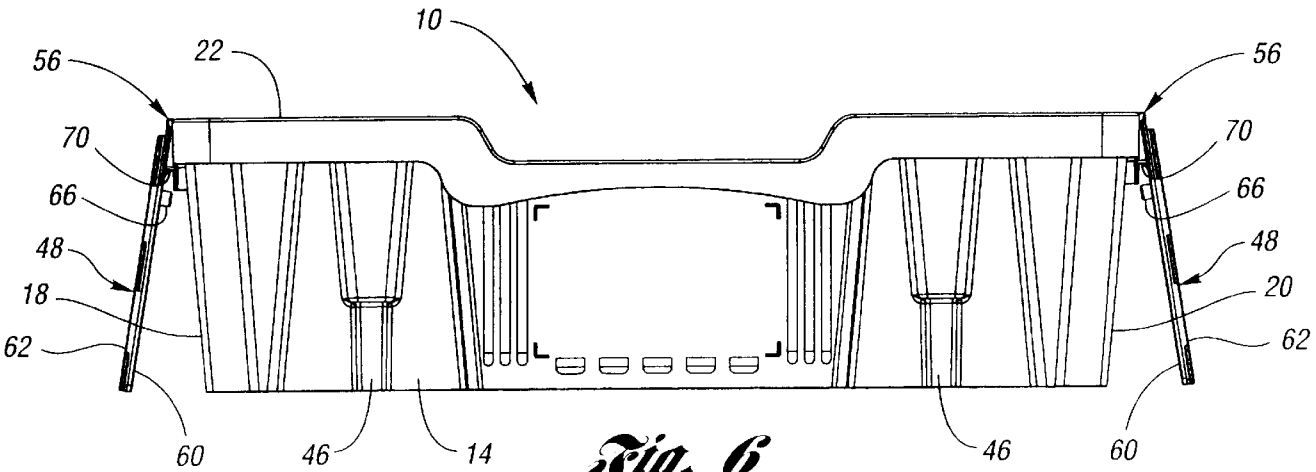
FIG. 6 is a side elevational view of the container showing the lids secured to the container in an open position.

As shown in FIGS. 1–2 and 4–6, container 10 includes at least one, and preferably a pair of generally planar lids 48, wherein each lid 48 includes a hinge edge 50, a pair of opposed side edges 52, and an end edge 54. Lids 48 are pivotably attached at hinge edges 50 to either side walls 14, 16, or preferably end walls 18, 20 (as shown in FIGS. 1–2 and 4–6) via a hinge 56 located along upper container rim 22. Hinge 56 is preferably a living hinge constructed to allow lids 48 to be rotated approximately 270° between a closed position, wherein lids 48 are oriented substantially parallel to bottom surface 12 (FIG. 4), and an open position, wherein lids are oriented substantially parallel to end walls 18, 20 (FIG. 6). In an alternative embodiment, lids 48 can be removably attached to side walls 14, 16 or end walls 18, 20.

As shown in FIG. 4, lids 48 at least partially, but preferably do not completely, cover container 10 in the closed position, and do not extend below the height of end walls 18, 20 in the fully open position, the advantages of which are explained below in association with FIGS. 12 and 13. Along upper container rim 22, hinge 56 can be formed by a plurality of hinge sections, as shown in FIGS. 1–2 and 4–6, or alternatively could extend along the entire length of each end wall 18, 20. When hinge 56 is formed in separate hinge sections, lids 48 preferably include indents 58 formed in end edges 54 such that a user is cued to insert his/her fingers and lift lids 48 in those locations opposite the hinge sections.

Figure 7:
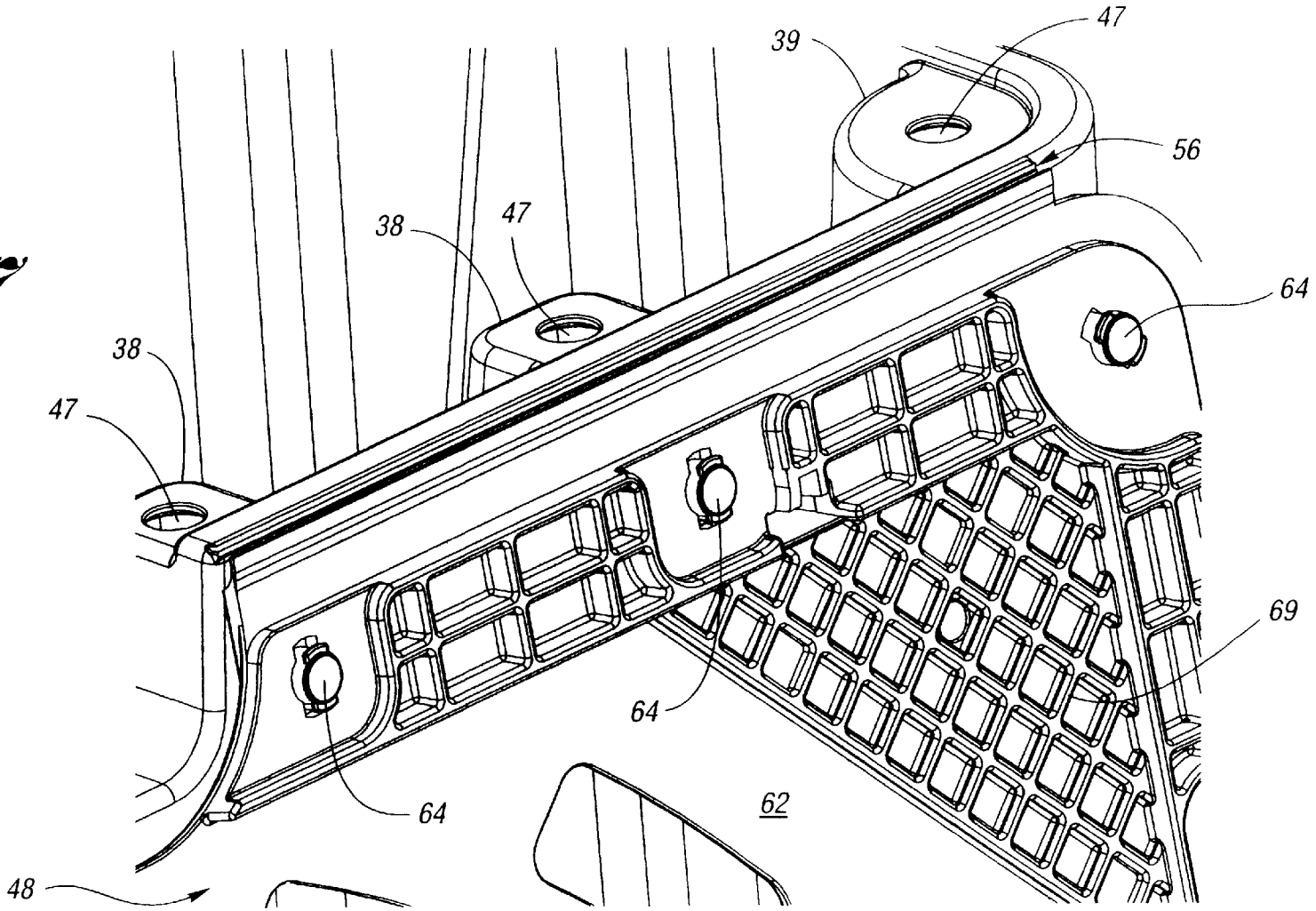
FIG. 7 is an enlarged, cut-away view of the securing projections and recesses provided on the container lid and columns, respectively, with the container lid in the open position.
Figure 14:
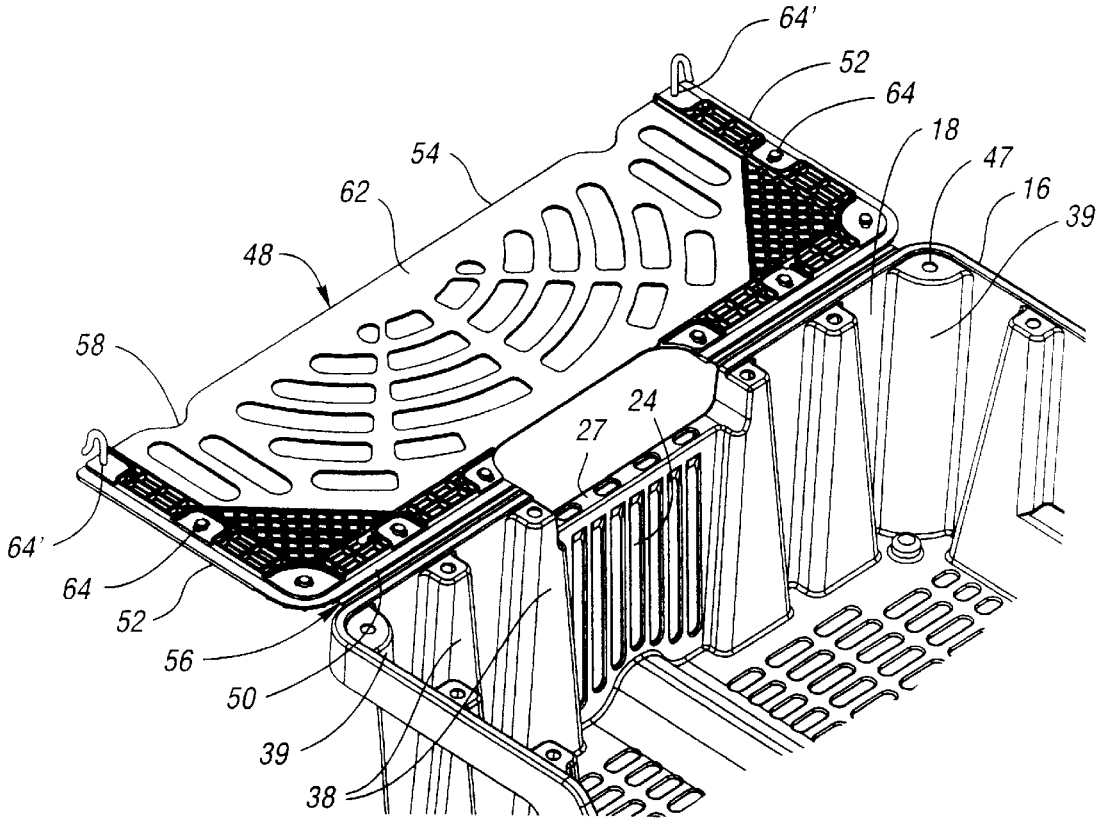
FIG. 14 is an enlarged, cut-away view of the container lid showing detail of the securing projections.

As with bottom surface 12, side walls 14, 16 and end walls 18, 20, lids 48 are preferably formed with ventilation apertures 24 to allow for the circulation of air throughout container 10 when covered and/or stacked. Still referring to FIGS. 1–2 and 4–6, lids 48 each include an upper surface 60 and a lower surface 62 with respect to the orientation of lids 48 when in the closed position (FIG. 4). Along the periphery of their lower surfaces 62, lids 48 include one or more securing projections 64, as best shown in FIG. 1 and the enlarged view of FIG. 7 Securing projections 64 are adapted to be received within corresponding securing recesses 47 of inner columns 38, 39 in side walls 14, 16 and end walls 18, 20 thereby securing each lid 48 onto container 10 at the closed position (FIG. 4). The engagement of securing projections 64 and recesses 47 is designed so that lids 48 fit securely on container 10 during routine handling and shipping, and are also easily removable to allow container 10 to be opened for inspection of its contents. It is understood, of course, that securing projections 64 and recesses 47 can be of any shape suitable to secure lids 48 in the closed position. For example, securing projections 64 can be compact or elongate 64' as shown in the enlarged view of FIG. 14. Furthermore, it is fully contemplated that the location of securing projections 64 and recesses 47 could be reversed, such that projections 64 would be provided on the upper surfaces of columns 38 and recesses 47 provided in or through the lower surfaces 62 of lids 48.

Figure 8:
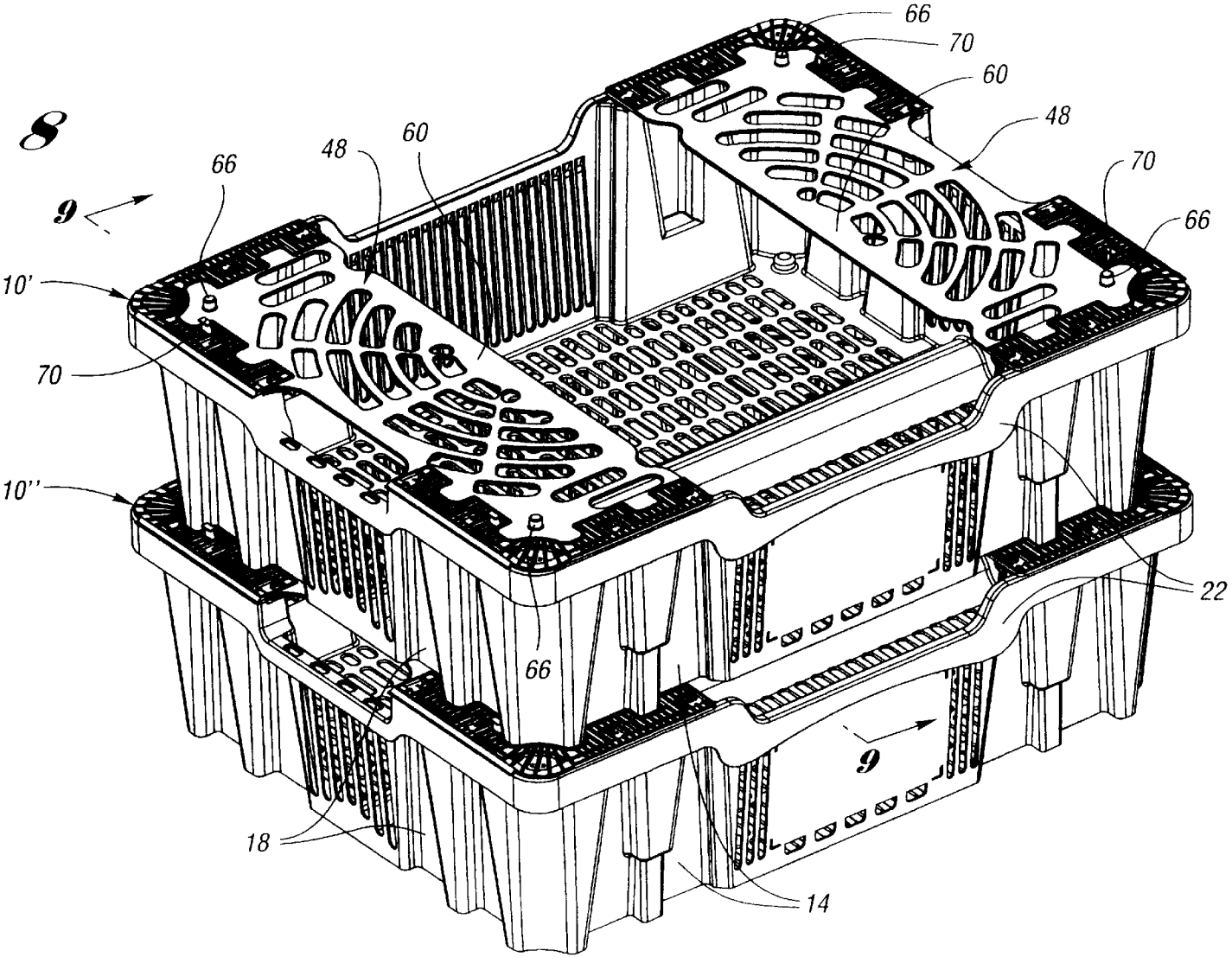
FIG. 8 is a perspective view showing two containers of the present invention in a stacked configuration.
Figure 9:
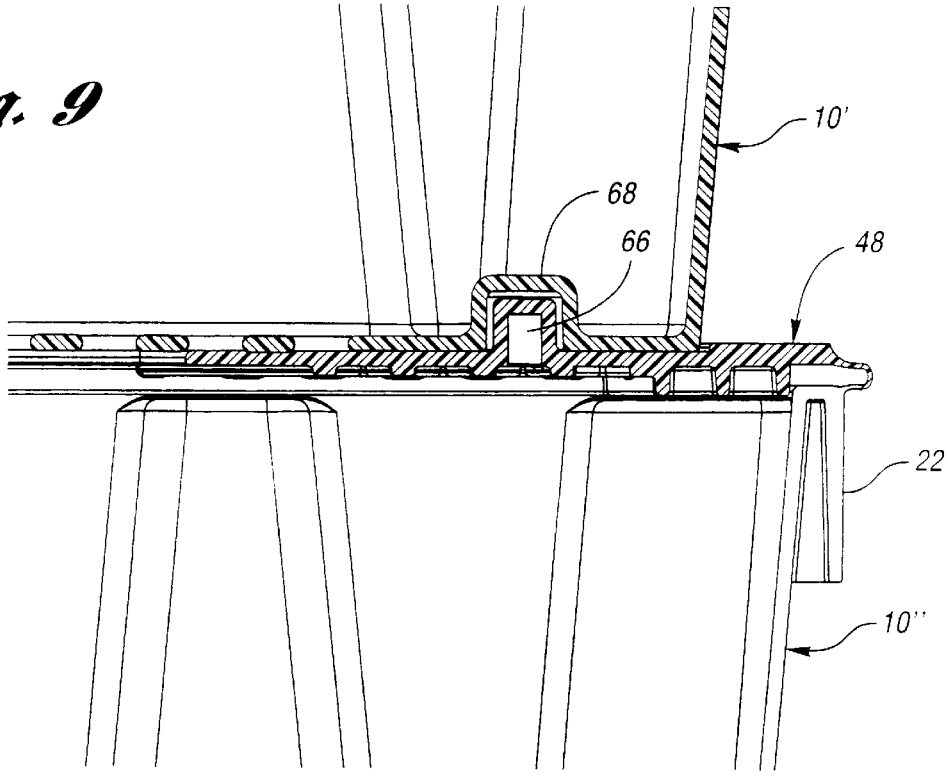
FIG. 9 is an enlarged, cross-sectional view taken along line 9—9 of FIG. 8 showing engagement of the stacking projections and stacking recesses of the stacked containers of FIG. 8.
Figure 10:
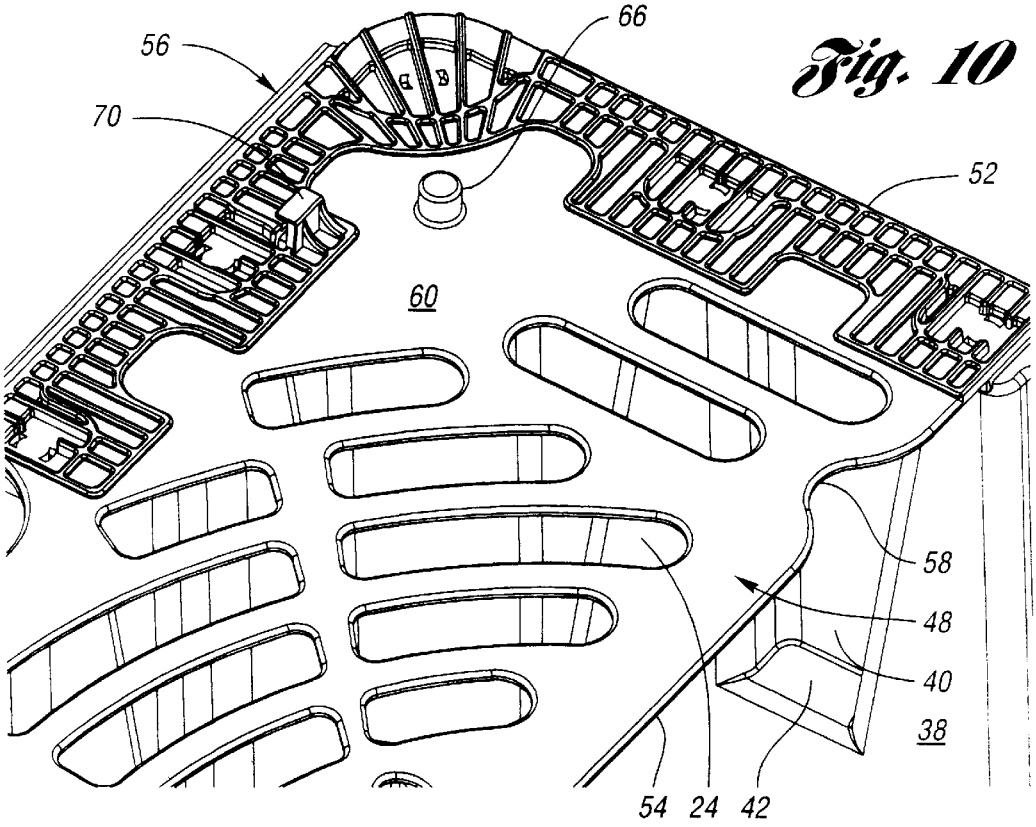
FIG. 10 is an enlarged, cut-away view of the container lid showing detail of a stacking projection and a latching tab.

Lids 48 provide a support surface so that containers 10 can be stacked. To aid in securing and aligning containers 10 in a stacked configuration, lids 48 include stacking projections 66 on their upper surfaces 60. Stacking projections 66 are adapted to be received within stacking recesses 68 formed in the underside of bottom surface 12, as best shown in FIGS. 2 and 3. An upper container 10' and a lower container 10" according to the present invention are shown in a stacked configuration in FIG. 8, with detail of the engagement between stacking projections 66 and stacking recesses 68 shown in the enlarged view of FIG. 9. In order to stack containers 10, an upper container 10' can be placed on a lower container 10" and then located properly via stacking projections 66 and recesses 68. The engagement of stacking projections 66 and recesses 68 assures proper alignment of containers 10 15 in order to form a straight vertical stack, and also prohibits containers 10 from sliding laterally in order to keep the stack stable.

When containers 10 are placed in a stacked configuration, lids 48 are heavily loaded. Inner columns 38 formed on side walls 14, 16 and end walls 18, 20 provide reinforcement and strength to lids 48, such that loading can be transferred from lids 48 to walls 14, 16, 18, 20. Less loading on lids 48 results in less stress to hinges 56, which will prolong their life. In addition, structural ribs 69 are provided on lower surface 62 of each lid 48 for supplementary reinforcement and torsional strength during stacking.

Figure 11:
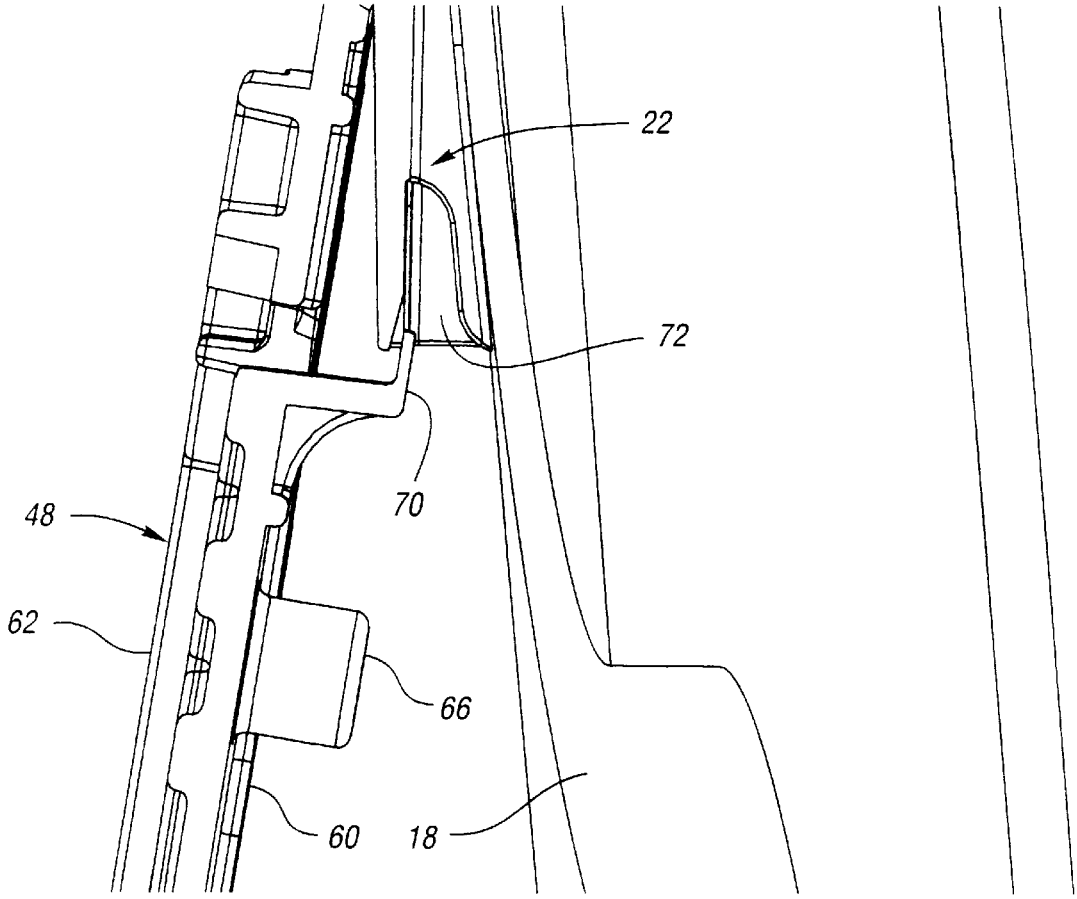
FIG. 11 is an enlarged, cut-away view of the container lid showing the latching tab engaged with the upper container rim.
Figure 15:
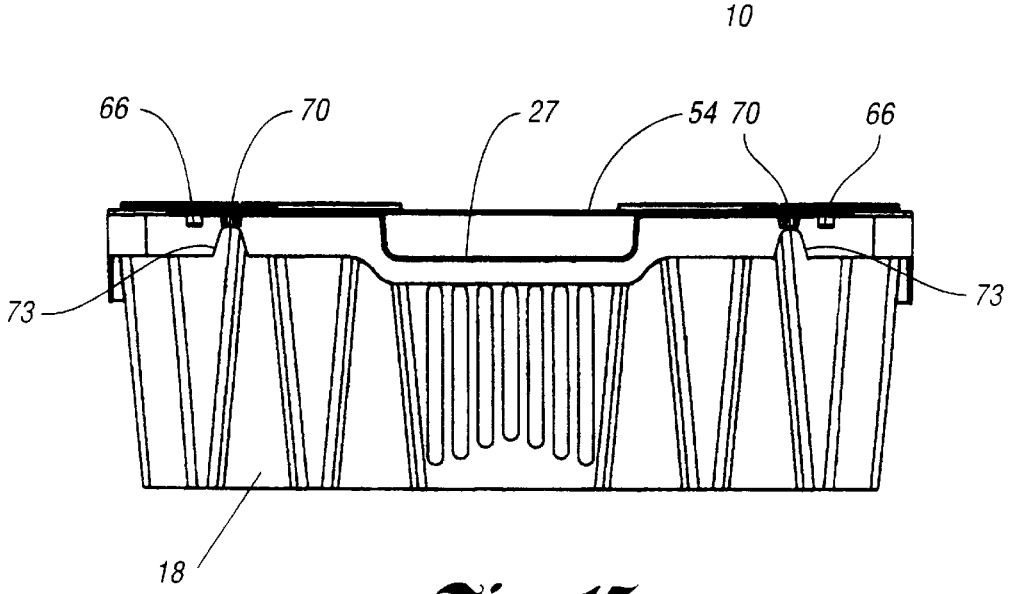
FIG. 15 is an end elevational view of the container showing detail of the upper container rim.

Referring now to FIGS. 5–6 and 10–11, upper surface 60 of each lid 48 also includes at least one latching tab 70. Latching tab 70 is designed to allow lids 48 to be secured to upper container rim 22 once rotated to the open position (FIG. 6). More particularly, a latch receiving area 72 is provided under upper container rim 22 and is sized to firmly receive latching tab 70, as best shown in FIG. 11. Alternatively, latching tabs 70 can be received in notches 73 formed in upper container rim 22 (FIG. 15). The ability to secure containers 10 in the open position allows produce to be displayed as well as for containers 10 to be nested for storage purposes, as described below.

Figure 12:
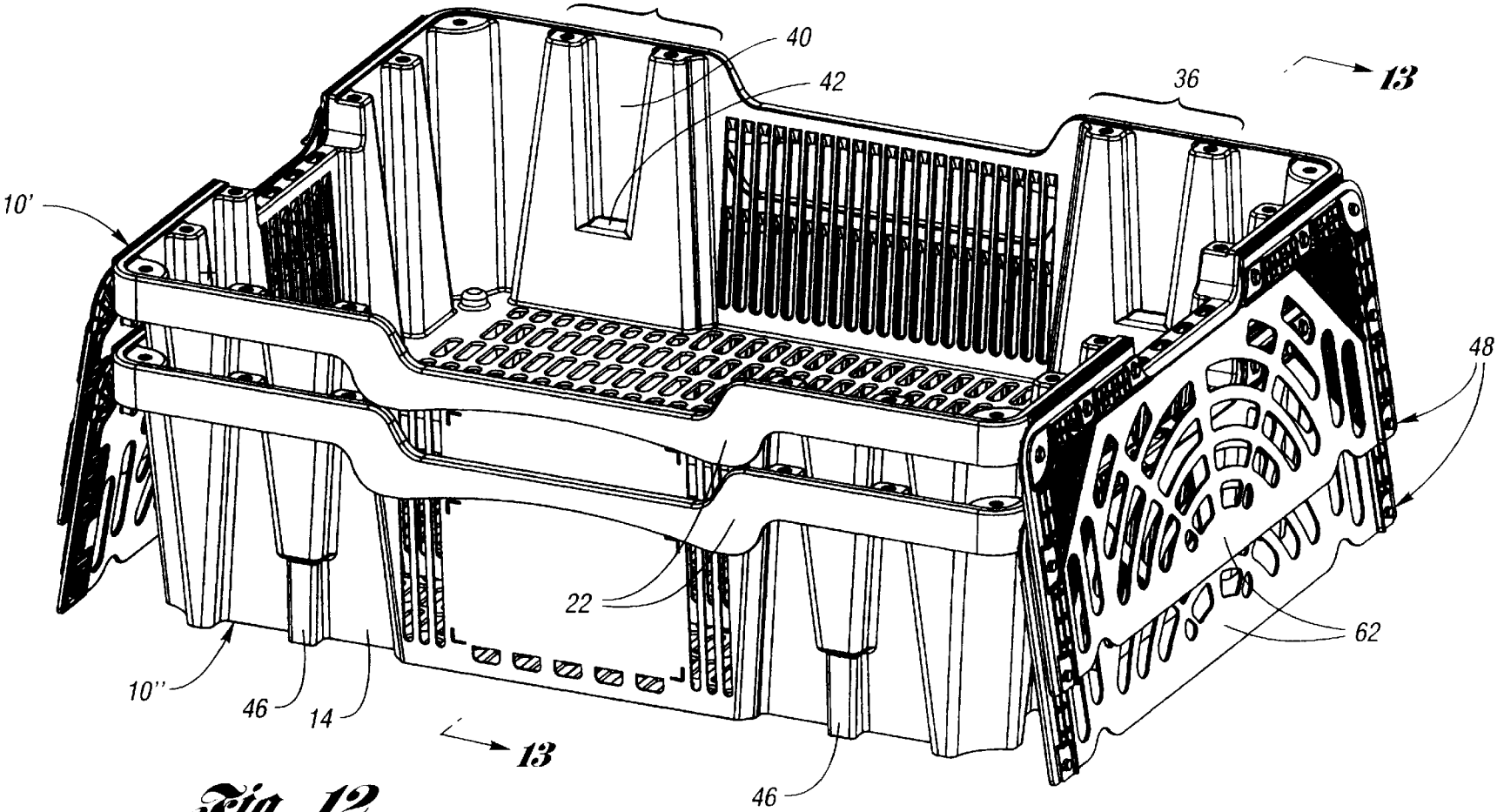
FIG. 12 is a perspective view showing two containers according to the present invention in a nested configuration.
Figure 13:
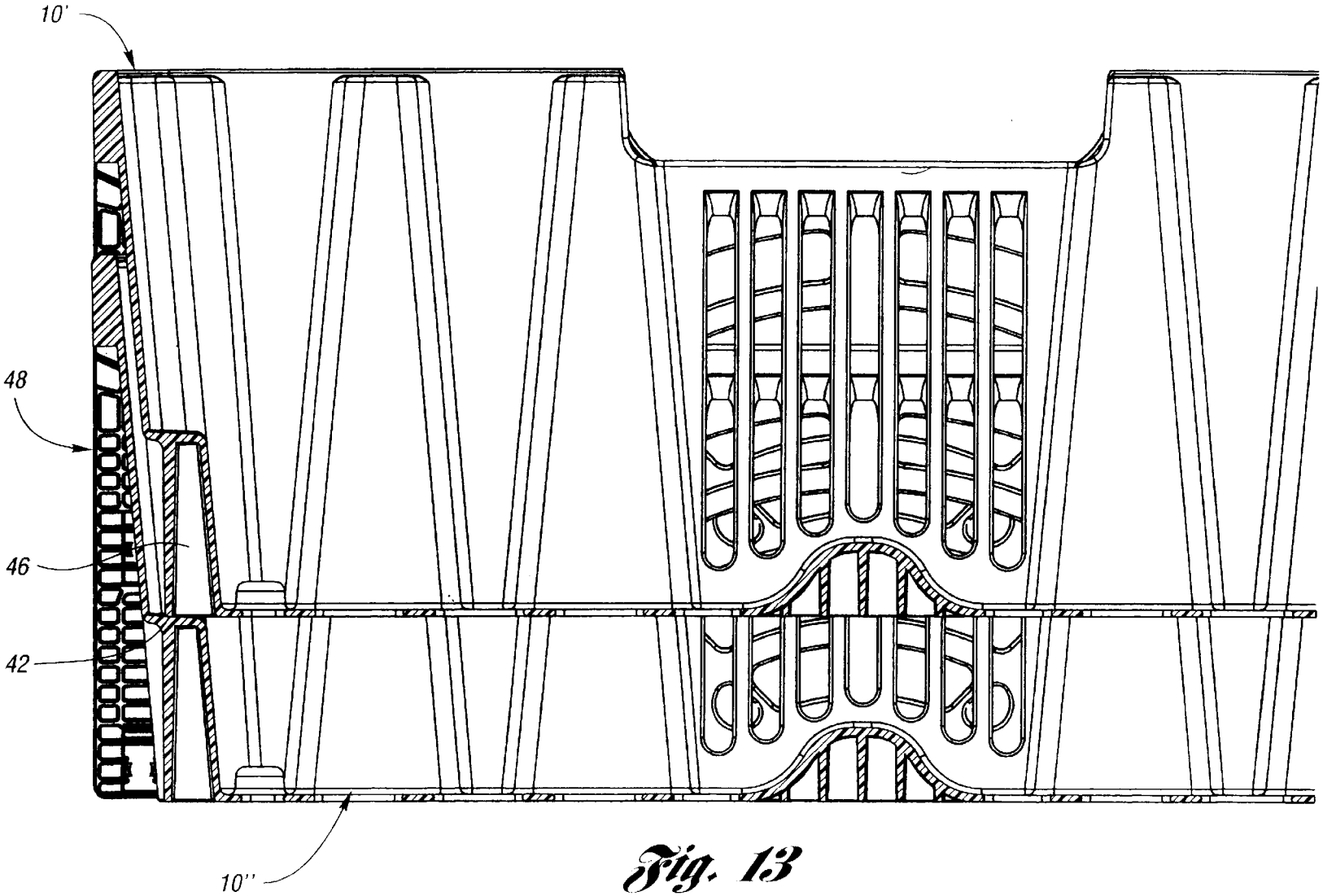
FIG. 13 is an enlarged, cross-sectional view taken along line 13—13 of FIG. 12 showing engagement of the outer column and recessed portion of the nested containers of FIG. 12.

FIG. 12 shows containers 10' and 10" of the present invention oriented in a nested configuration. The capability of placing containers 10 in a nested configuration minimizes the vertical space required to store empty containers 10. As shown, lids 48 preferably are not longer than the height of end walls 18, 20. Advantageously, therefore, lids 48 do not substantially increase the footprint of containers 10 when secured in the open position, such that increases in the floor space required to store containers 10 when nested are avoided. Referring to the cross-sectional view illustrated in FIG. 13, nesting among containers 10 is accomplished by allowing outer columns 46 of an upper container 10' to rest upon corresponding inner shelves 42 of a lower container 10". Therefore, a slight gap is formed between bottom surface 12 of upper container 10' and bottom surface 12 of lower container 10". In a preferred embodiment, containers 10 of the present invention are dimensioned such that they nest in a ratio of about 3:1. That is, when upper container 10' nests within lower container 10", the height of lower container 10" is about three (3) times the distance which upper container 10' projects above upper container rim 22 of lower container 10". If lids 48 are constructed to be removably attached to container 10, lids 48 can be placed in container 10 and rest or bottom surface 12 during nesting such that lids 48 are stored in the slight gap between containers 10 and not misplaced.

While embodiments of the invention have been illustrated and described, it is not intended that these embodiments illustrate and describe all possible forms of the invention. Rather, the words used are words of description rather than limitation, and it is understood that various changes may be made without departing from the spirit and scope of the invention.

What is claimed is:

1. A multi-purpose container comprising:

a first pair of opposed walls;

a second pair of opposed walls integrally joined with the first pair of oppposed walls; and a bottom surface integrally joined with the first and second pairs of opposed walls such that the first and second pairs of opposed walls extend upwardly from the bottom surface to define a storage area, the bottom surface having a ridge including at least one vertical rib which extends along the bottom surface between one of the first and second pairs of opposed walls and has an upper end that is covered by a top layer so as to define a smooth profile along the bottom surface, wherein the ridge provides reinforcement to the container.

2. The container according to claim 1, wherein the ridge extends along a central portion of the bottom surface.

3. The container according to claim 1, wherein the at least one vertical rib includes a plurality of spaced apart vertical ribs joined by the top layer.

4. The container according to claim 3, wherein the plurality of ribs vary in height.

5. The container according to claim 1, wherein at least one of the bottom surface, the first pair of opposed walls, and the second pair of opposed walls includes a plurality of ventilation apertures.

6. The container according to claim 1, wherein one of the first and second pairs of opposed walls includes a wall having a substantially flat open surface area for displaying a label.

7. The container according to claim 1, further comprising at least one lid adapted to at least partially cover the container.

8. The container according to claim 7, wherein the at least one lid includes a plurality of ventilation apertures.

9. The container according to claim 7, further including an upper container rim formed along upper portions of the first and second pairs of opposed walls.

10. The container according to claim 9, wherein the at least one lid is pivotably attached via a hinge to the upper container rim along one of the first and second pairs of opposed walls.

11. The container according to claim 10, wherein the hinge is formed by a plurality of hinge sections.

12. The container according to claim 11, wherein the at least one lid include indents formed in end edges thereof to receive a user's fingers.

13. The container according to claim 10, wherein the at least one lid is rotatable between a closed position and an open position.

14. The container according to claim 13, wherein the at least one lid is rotatable approximately 270°.

15. The container according to claim 13, wherein the at least one lid includes at least one latching tab for securing the lid to the upper container rim when the lid is in the open position.

16. The container according to claim 13, wherein the at least one lid includes at least one securing projection formed on a lower surface thereof and the first and second pairs of opposed walls include at least one securing recess in an upper surface thereof corresponding to the securing projection, wherein the securing projection is adapted to be received in the corresponding securing recess in order to secure the lid in the closed position.

17. The container according to claim 16, wherein the first and second pairs of opposed walls include spaced inner columns formed therein, each inner column provided with a securing recess formed in an upper surface thereof.

18. The container according to claim 7, wherein the at least one lid includes stacking projections formed on an upper surface thereof and the bottom surface includes stacking recesses formed in an underside thereof, wherein in a stacked configuration the stacking projections of a lower container are adapted to be received within the stacking recesses of an adjacent upper container.

19. The container according to claim 7, wherein the at least one lid is removably attached to the container.

20. The container according to claim 1, wherein one of the first and second pairs of opposed walls includes column sections formed therein, each column section having a recessed portion and a lower column support.

21. The container according to claim 20, wherein one of the first and second pairs of opposed walls includes outer columns formed on an exterior surface thereof opposite the lower column supports.

22. The container of claim 21, wherein in a nested configuration the recessed portion of a lower container is adapted to receive the outer column of an adjacent upper container.

23. The container according to claim 1, wherein the containers have a 3:1 nesting ratio.

24. A multi-purpose container comprising:

a first pair of opposed walls having an upper portion;

a second pair of opposed walls having an upper portion and integrally joined with the first pair of opposed walls, wherein the upper portions of the first and second pairs of opposed walls define an upper container rim;

a bottom surface integrally joined with the first and second pairs of opposed walls such that the first and second pairs of opposed walls extend upwardly from the bottom surface to define an inner compartment, the bottom surface having a raised member including a plurality of spaced apart, vertical ribs which extend along a central portion of the bottom surface between one of the first and second pairs of opposed walls, the ribs varying in height and having upper ends that are joined by a top layer so as to define a smooth profile along the bottom surface, wherein the raised member provides reinforcement to the container.

25. The container according to claim 24, further comprising a pair of lids adapted to at least partially cover the container.

26. The container according to claim 25, wherein at least one of the bottom surface, the first pair of opposed walls, the second pair of opposed walls, and the lids includes a plurality of ventilation apertures.

27. The container according to claim 25, wherein each lid is pivotably attached via a hinge to the upper container rim along one of the first and second pairs of opposed walls, the hinge allowing the lids to be rotated between a closed position and an open position.

28. The container according to claim 27, wherein each lid includes at least one latching tab on an upper surface thereof for securing the lid to the upper container rim in the open position.

29. The container according to claim 27, wherein each lid includes securing projections formed on a lower surface thereof and the first and second pairs of opposed walls include spaced inner columns formed therein, each inner column provided with a securing recess in an upper surface thereof, wherein the securing projections are adapted to be received in the securing recesses in order to secure the lid in the closed position.

30. The container according to claim 25, wherein each lid includes stacking projections formed on an upper surface thereof and the bottom surface includes stacking recesses formed in an underside thereof, wherein in a stacked configuration the stacking projections of a lower container are adapted to be received within the stacking recesses of an adjacent upper container.

31. The container according to claim 24, wherein one of the first and second pairs of opposed walls includes column sections formed therein, each column section having a recessed portion and a lower column support, and wherein one of the first and second pairs of opposed walls includes outer columns formed on an exterior surface thereof opposite the lower column supports.

32. The container of claim 31, wherein in a nested configuration the recessed portion of a lower container is adapted to receive the outer column of an adjacent upper container.

33. A plastic multi-purpose container comprising:

a pair of opposed side walls;

a pair of opposed end walls integrally joined with the side walls, wherein the side walls and the end walls have an upper container rim formed along upper surfaces thereof and include spaced inner columns formed therein, each inner column provided with a securing recess in an upper surface thereof;

a bottom surface integrally joined with the side walls and the end walls such that the side walls and the end walls extend upwardly from the bottom surface to define a storage area, the bottom surface having a ridge including a plurality of spaced apart, vertical ribs which extend along a central portion of the bottom surface between the end walls, the ribs varying in height and having upper ends that are joined by a top layer so as to define a smooth profile along the bottom surface, wherein the ridge provides reinforcement to the container; and at least one lid adapted to at least partially cover the container, the lid pivotably attached via a hinge to the upper container rim along the end walls, wherein the hinge allows the lid to be oriented between a first position and a second position, the lid including securing projections formed on a lower surface thereof which are adapted to be received in the securing recesses in order to secure the lid in the first position, wherein the lid includes at least one latching tab on an upper surface thereof for securing the lid to the upper container rim when the lid is disposed in the second position.

34. The container according to claim 33, wherein at least one of the bottom surface, the side walls, the end walls, and the at least one lid includes a plurality of ventilation apertures.

35. The container according to claim 33, wherein the side walls have column sections formed therein, each column section having a recessed portion and a lower column support, the side walls further including outer columns formed on an exterior surface thereof opposite the lower column supports, wherein in a nested configuration the recessed portion of a lower container is adapted to receive the outer column of an adjacent upper container.

36. The container according to claim 33, wherein the bottom surface includes stacking recesses formed in an underside thereof and the lid includes stacking projections formed on an upper surface thereof, wherein in a stacked configuration the stacking projections of a lower container are adapted to be received within the stacking recesses of an adjacent upper container.

* * * * *